US007409840B2

(12) United States Patent
Kao

(10) Patent No.: US 7,409,840 B2
(45) Date of Patent: Aug. 12, 2008

(54) YARN DEBRIS REMOVING APPARATUS FOR CIRCULAR DISCOLORATION KNITTING MACHINES

(75) Inventor: Kuo-Jung Kao, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 120 days.

(21) Appl. No.: 11/582,301

(22) Filed: Oct. 18, 2006

(65) Prior Publication Data

US 2008/0141728 A1 Jun. 19, 2008

(51) Int. Cl.
*D04B 35/32* (2006.01)

(52) U.S. Cl. ..... 66/168

(58) Field of Classification Search ..... 66/8, 66/168, 114, 115

See application file for complete search history.

(56) References Cited

U.S. PATENT DOCUMENTS 5,363,676 A * 11/1994 Tsuchiya ..... 66/168
5,408,850 A * 4/1995 Kawase et al. ..... 66/168
5,675,991 A * 10/1997 Shelton et al. ..... 66/168
5,737,942 A * 4/1998 Gutschmit ..... 66/168
6,199,408 B1 * 3/2001 Shibata ..... 66/8
6,247,335 B1 * 6/2001 Schaeberle et al. ..... 66/9 B
6,370,923 B1 * 4/2002 Chol ..... 66/168
7,036,340 B1 * 5/2006 Chen ..... 66/8
7,043,941 B2 * 5/2006 Willmer et al. ..... 66/168
7,269,977 B1 * 9/2007 Pai ..... 66/168

FOREIGN PATENT DOCUMENTS

TW 182863 4/1992
TW 517722 1/2003

* cited by examiner

*Primary Examiner*—Danny Worrell
(74) *Attorney, Agent, or Firm*—Muncy, Geissler, Olds & Lowe, PLLC

(57) ABSTRACT

A yarn debris removing apparatus for circular discoloration knitting machines provides compressed air through an air compressor. The compressed air is delivered to a negative pressure generator through a rotary connector that controls the flow direction of the compressed air so that a negative pressure suction nozzle forms a negative pressure to generate a suction force to suck yarn debris cut off on a circular discoloration knitting machine. The negative pressure generator is connected to a dust collection net on another end through a hose to collect and filter out the yarn debris to reproduce clean air. Through the rotary connector the dust collection net and the negative pressure generator can be rotated with the circular discoloration knitting machine. The suction nozzle of the negative pressure generator is directed towards the needles of the circular discoloration knitting machine where change of yarns takes place to suck the yarn debris.

9 Claims, 5 Drawing Sheets

YARN DEBRIS REMOVING APPARATUS FOR CIRCULAR DISCOLORATION KNITTING MACHINES

FIELD OF THE INVENTION

The present invention relates to a yarn debris removing apparatus for circular discoloration knitting machines that generates air force through an air compressor to suck yarn debris and has a negative pressure generator with a suction nozzle on one end to generate a negative pressure through compressed airflow to suck the yarn debris cut off during changing patterns of fabrics on a circular discoloration knitting machine into a dust collection net.

BACKGROUND OF THE INVENTION

Circular knitting machines are widely used now in the textile industry. Many new types of circular knitting machines have been developed to increase operation efficiency and enrich function. These days there are circular knitting machines that can change yarns to alter colors and patterns of the fabrics. This is accomplished by altering different color of yarns on the needles. Each time the yarn of one color is changed, the original yarn has to be cut off, and another color of yarn is used to continue knitting operation. If the debris of the cut off yarn is not properly handled and scatters, it could be gathered in the fabric and form small patches of motley patterns. To remove the yarn debris takes a great deal of extra labor and time.

To remedy the aforesaid problem, R.O.C. patent publication No. 182863 discloses a technique which has an air duct extended from the interior of a circular knitting machine to connect to a suction machine located outside the knitting machine. It has to provide an extra blower outside the knitting machine to generate suction force. As the air duct is extended from the interior of the knitting machine to the blower, the air duct is too long and bent and twisted. As a result the suction force decreases. And yarn debris and flints tend to accumulate in the duct and result in clogging. Utilization efficiency suffers. R.O.C. patent publication No. 517722 discloses another technique which has a blower to generate airflow to prevent yarn flints and debris depositing on the knitting machine. It also has a lengthy duct that weakens the airflow. Hence a powerful blower has to be used. The cost is higher and maintenance is more difficult. All the conventional techniques still leave a lot to be desired. There are still rooms for improvement.

SUMMARY OF THE INVENTION

Therefore the present invention aims to provide a yarn debris removing apparatus for circular discoloration knitting machines that employs an air compressor used in the conventional circular knitting machine as the source of airflow without the need of procuring an extra blower. The air compressor is connected to a rotary connector on an upper side of a circular discoloration knitting machine through a connection duct. The rotary connector has a lower end turnable with the circular discoloration knitting machine. Compressed air is sent to a negative pressure generator through the rotary connector. By controlling the flow direction of the compressed air a negative pressure is formed in a negative pressure suction nozzle of the negative pressure generator. Hence a suction force is generated to suck yarn debris cut off in the circular discoloration knitting machine. And the discarded yarn debris is discharged through another end of the negative pressure generator and collected in a dust collection net. Air is filtered and cleaned. As the rotary connector can be rotated with the circular discoloration knitting machine, the dust collection net and the negative pressure generator are constantly directed towards the circular discoloration knitting machine to suck the yarn debris.

In short, this invention has the duct collection net located inside the circular discoloration knitting machine and rotated therewith. It can be directed constantly to the needles where yarn changing takes place to suck the yarn debris, thus yarn debris collecting efficiency increases. By providing airflow through the air compressor, there is no need to procure an extra blower, hence the cost is reduced.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
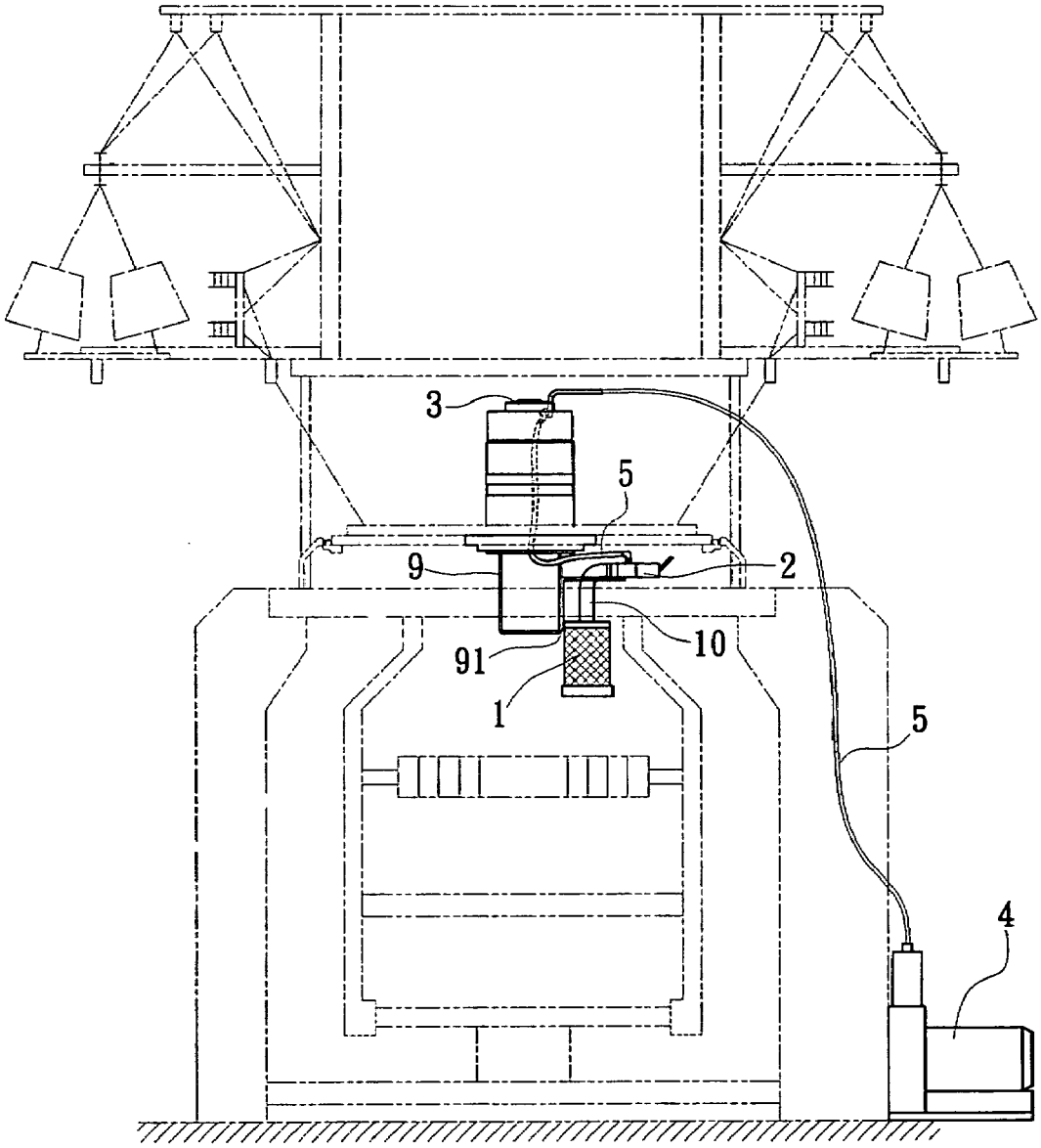
FIG. 1 is a plane view of the invention.

Please refer to FIG. 1 for an embodiment of the invention. The yarn debris removing apparatus for circular discoloration knitting machines of the invention is installed in the center of a circular discoloration knitting machine. It mainly includes a filter net 1 and a negative pressure generator 2 connecting to the filter net 1 through a hose 10. The filter net 1 and the negative pressure generator 2 are fastened to a fabric extension holding bracket 9 of the circular discoloration knitting machine through a L-shaped anchor rack 91. The negative pressure generator 2 is connected to an electric adaptor on an upper side that has a power input connector on an upper portion and a power output connector on a lower end, and has a passage to allow air to pass through. The electric adaptor may be a rotary connector 3 with another end connecting to a pressurized air generator such as an air compressor 4. The negative pressure generator 2, rotary connector 3 and air compressor 4 are linked through a connection duct 5 to deliver compressed air so that the negative air generator 2 can generate a negative pressure through the compressed air to suck the discarded yarn debris.

Figure 2:
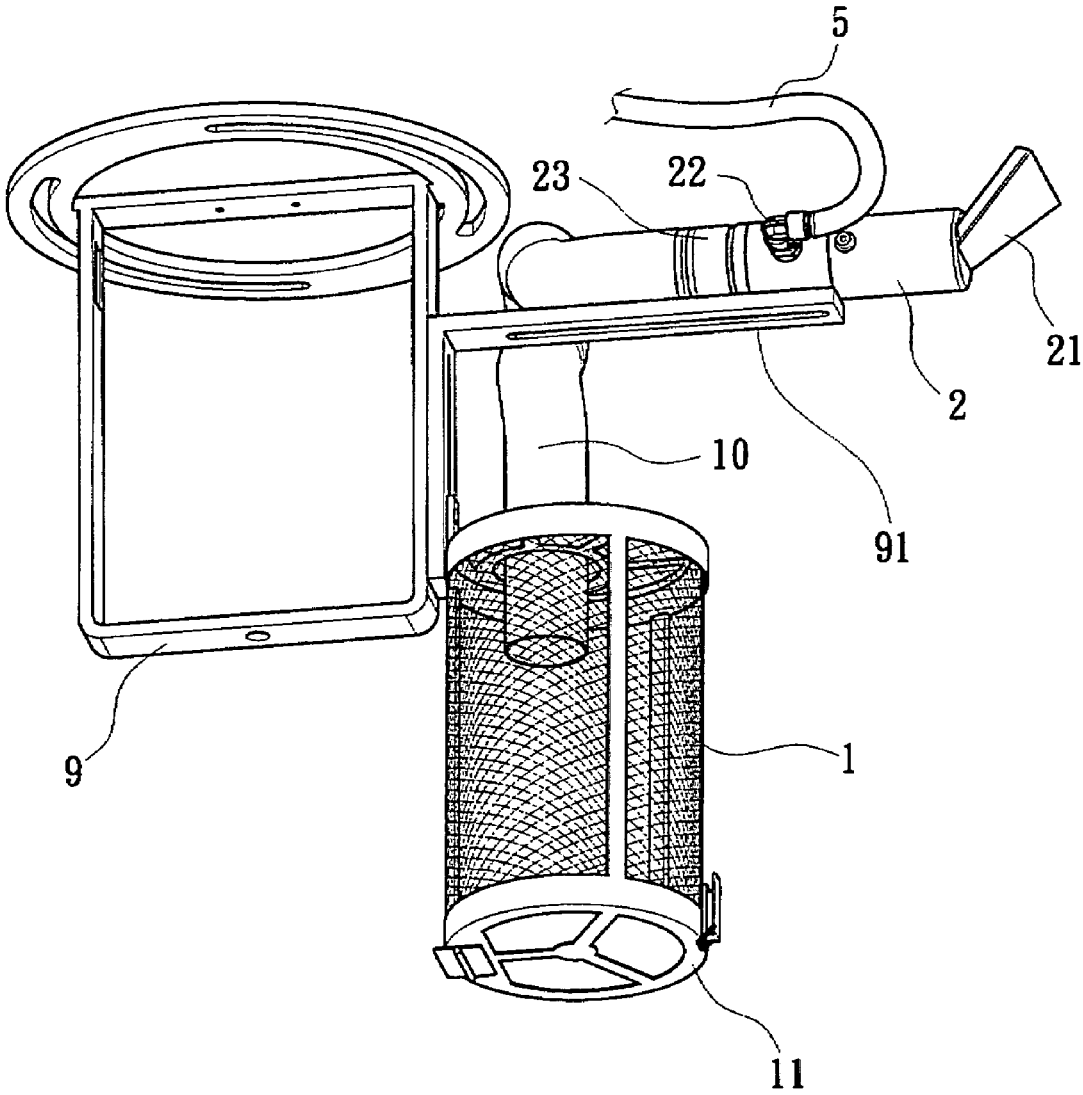
FIG. 2 is a fragmentary perspective view of the invention.

Referring to FIG. 2, the filter net 1 is wedged in an iron frame 11. The iron frame 11 and the L-shaped anchor rack 91 are firmly fastened to the fabric extension holding bracket 9. The L-shaped anchor rack 91 may also hold the hose 10 and the negative pressure generator 2. The filter net 1 is connected to an air outlet 23 on one end of the negative pressure generator 2 through the hose 10. The negative pressure generator 2 has a negative pressure suction nozzle 21 on another end. The negative pressure generator 2 further has an air inlet 22 on an outer side to channel the compressed air into the negative pressure generator 2 through the connection duct 5.

Figure 3:
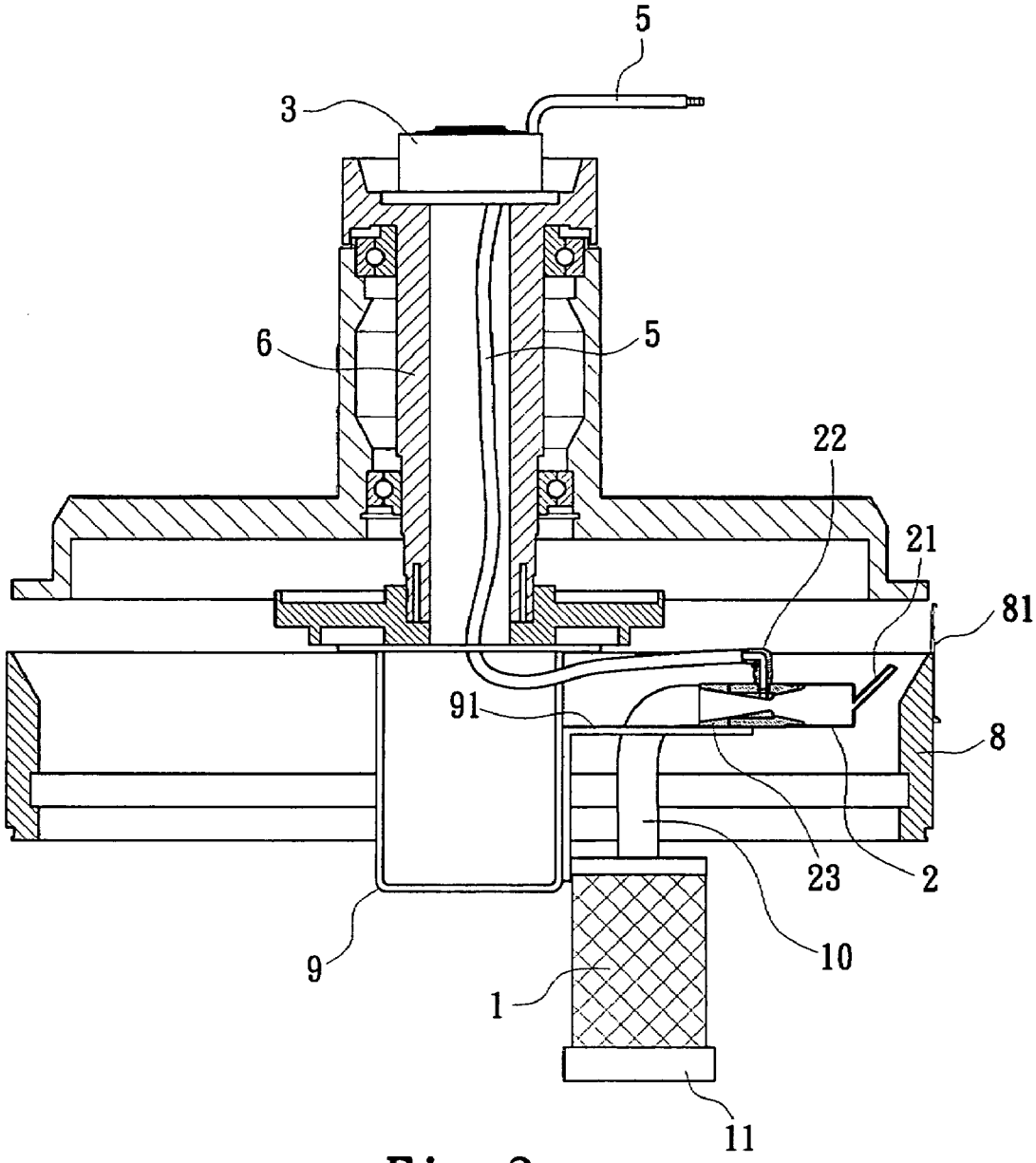
FIG. 3 is a schematic view of the invention in an assembled condition.
Figure 4:
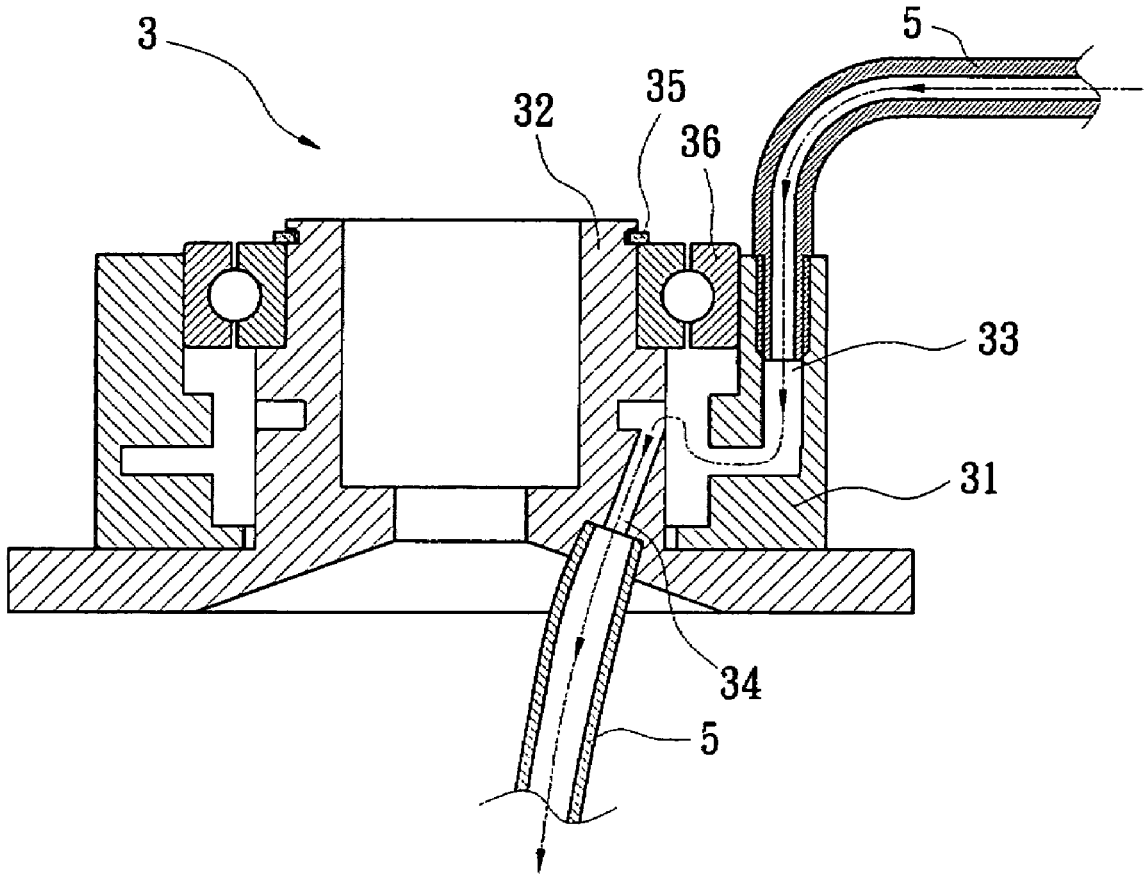
FIG. 4 is a sectional view of the rotary connector of the invention.

Refer to FIGS. 3 and 4 for the invention in an assembled condition and the rotary connector. The negative pressure generator 2 connected to the filter net 1 has the air outlet 23 on one end and the negative pressure suction nozzle 21 on another end. The negative pressure suction nozzle 21 is directed towards needles 81 of a selected cylinder 8 where change of yarns takes place. The negative pressure generator 2 further has the air inlet 22 on the outer side to couple with the connection duct 5 which runs through a ball disk located above the fabric extension holding bracket 9 and a center shaft 6 in the center to be connected to an electric connector located on an upper side of the center shaft 6. The electric connector is a rotary connector 3 which has an anchor portion 31 and a rotary portion 32 that can rotate relative to each other through a washer 35 and a bearing 36 interposed between them, and also allow electricity and air to pass through. The anchor portion 31 and the rotary portion 32 are electrically connected through a mercury or carbon brush contact, and also have a passage between them to allow air to pass through so that the negative pressure generator 2 in the circular discoloration knitting machine can be connected to the air compressor 4 located outside the circular discoloration knitting machine. The rotary portion 32 and the anchor portion 31 have respectively an air outlet connector 34 and an air intake connector 33 that are connected to the connection duct 5 which is connected to the air compressor 4 so that compressed air can pass through the connection duct 5, air intake connector 33 and the passage between the anchor portion 31 and the rotary portion 32 to be delivered through the air outlet connector 34 and the connection duct 5 to the negative pressure generator 2.

Figure 5:
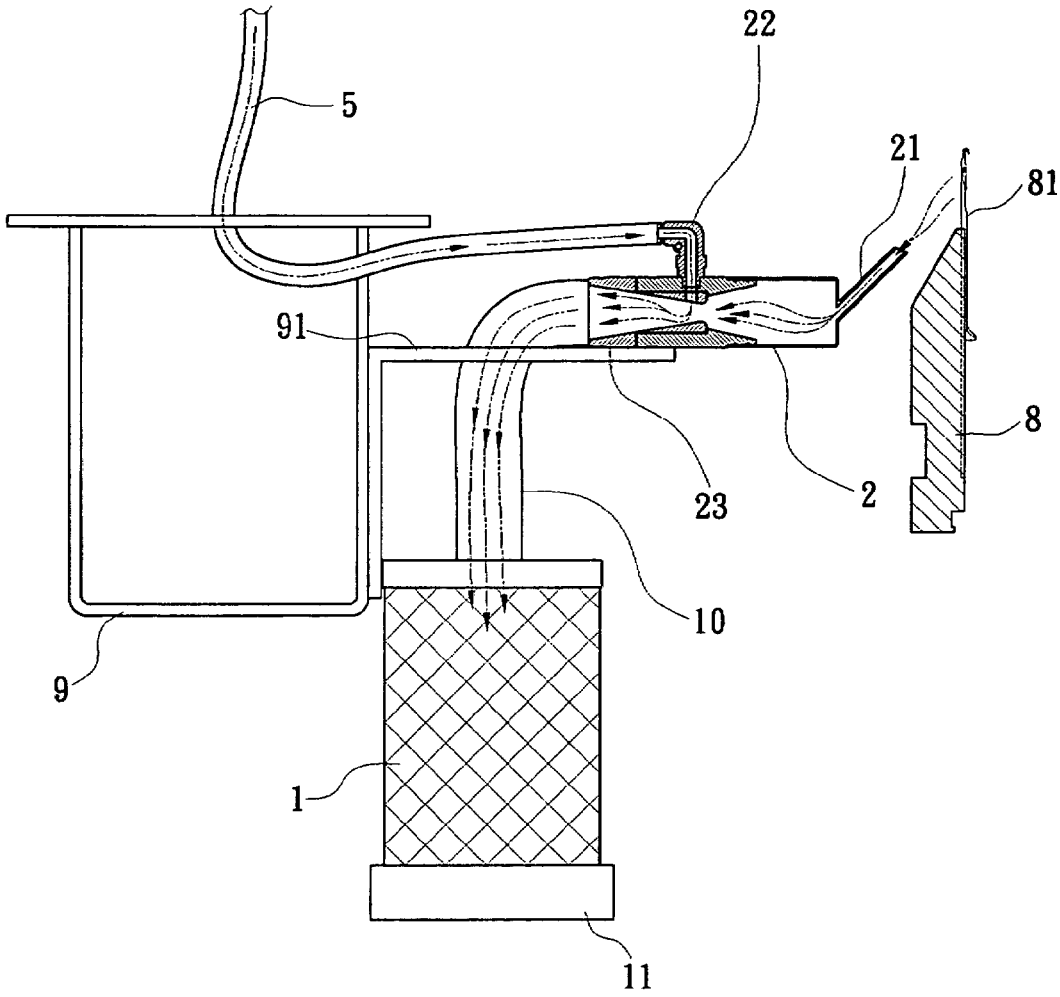
FIG. 5 is a schematic view of an embodiment of the invention.

Referring to FIG. 5, when in use, the air compressor 4 generates compressed air which passes through the connection duct 5 and the rotary connector 3, and the air inlet 22 to the negative pressure generator 2. The negative pressure generator 2 controls air through an inclined surface and alterations of duct size, and discharges the air through the air outlet 23 so that the negative pressure suction nozzle 21 on another end has a negative pressure and generates a suction force. As change of yarns in the circular discoloration knitting machine is preset and proceeded on the needles 81 of the selected cylinder 8, the negative pressure suction nozzle 21 can be directed constantly to the needles 81 where change of the yarns takes place. Hence when the circular discoloration knitting machine is in operation, as the yarn debris removing apparatus of the invention is fastened to the fabric extension holding bracket 9, it can be rotated with the circular discoloration knitting machine. Air is channeled in through the rotary connector 3. Tangling of the yarns can be prevented. The apparatus of the invention is constantly directed towards the needles 81 where change of the yarns takes place to suck the discarded yarn debris. The yarn debris is conveyed through the air outlet 23 and hose 10 to the filter net 1 to be filtered out and collected for centralized treatment.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A yarn debris removing apparatus for a circular discoloration knitting machine which has a cylinder rotating about a center shaft and containing a plurality of needles which are movable to perform knitting operation, the yarn debris removing apparatus aiming to remove yarn debris generated during the knitting operation of the circular discoloration knitting machine and comprising:

a pressurized air generator to supply compressed air;

an electric adaptor which has an air intake connector fixedly located on an upper side of the circular discoloration knitting machine to connect to the pressurized air generator to receive the compressed air, and an air outlet connector on a lower end rotating with the cylinder and being connected to the air intake connector to output the compressed air; and a negative pressure generator which is fixedly located below the air outlet connector and rotated synchronously therewith, and has an air inlet, an air outlet and a negative pressure suction nozzle, the air inlet being connected to the air intake connector to input the compressed air, the negative pressure suction nozzle being directed towards the needles, the air outlet being covered by a dust collector to discharge the compressed air and filter out the yarn debris generated during the knitting operation onto the needles and sucked by the negative pressure suction nozzle.

2. The yarn debris removing apparatus of claim 1, wherein the electric adaptor has a power input connector on an upper end fixedly located above the knitting machine to input power supply and a power output connector on a lower end rotating with the cylinder and being electrically connected to the power input connector to output the power supply.

3. The yarn debris removing apparatus of claim 2, wherein the power input connector and the power output connector are electrically connected through a mercury contact.

4. The yarn debris removing apparatus of claim 2, wherein the power input connector and the power output connector are electrically connected through a carbon brush contact.

5. The yarn debris removing apparatus of claim 1, wherein the compressed air generated by the pressurized air generator is conveyed to the air intake connector through a connection duct.

6. The yarn debris removing apparatus of claim 1, wherein the compressed air output through the air outlet connector is conveyed to the air inlet through a connection duct.

7. The yarn debris removing apparatus of claim 1, wherein the pressurized air generator is an air compressor.

8. The yarn debris removing apparatus of claim 1, wherein the dust collector is a filter net.

9. The yarn debris removing apparatus of claim 1, wherein the negative pressure suction nozzle is directed towards the needles where change of yarns of different colors for the knitting operation takes place.

* * * * *